US006575546B2

(12) United States Patent
Matsumoto et al.

(10) Patent No.: US 6,575,546 B2
(45) Date of Patent: Jun. 10, 2003

(54) INK JET PRINTER, INK JET PRINTING METHOD AND CONTINUOUS RECORDING SHEET

(75) Inventors: Nobuo Matsumoto, Kanagawa (JP); Eiichi Kito, Kanagawa (JP); Kiyotaka Kaneko, Kanagawa (JP); Yasuyuki Hosono, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/864,867

(22) Filed: May 25, 2001

(65) Prior Publication Data

US 2002/0001006 A1 Jan. 3, 2002

(30) Foreign Application Priority Data

May 25, 2000 (JP) ..... 2000-154807
Apr. 5, 2001 (JP) ..... 2001-107335

(51) Int. Cl.[7] ..... B41J 29/38

(52) U.S. Cl. ..... 347/14; 347/19; 347/104; 400/708

(58) Field of Search ..... 347/8, 14, 16, 347/19, 104, 133; 346/136; 400/583, 583.3, 621, 708; 428/57–62; 358/1.18; 271/184, 303; 391/82, 86; 83/105, 106

(56) References Cited

U.S. PATENT DOCUMENTS 3,375,744 A * 4/1968 Schieven ..... 83/23
3,493,448 A * 2/1970 Powell et al. ..... 156/73.4
3,591,279 A * 7/1971 Gardner et al. ..... 355/29
4,264,825 A * 4/1981 Bowen ..... 250/559.03
4,376,587 A * 3/1983 Rex ..... 400/247
4,901,577 A * 2/1990 Roberts ..... 73/600
4,931,828 A * 6/1990 Fujita et al. ..... 355/45
5,255,055 A * 10/1993 Mahoney ..... 399/160
5,854,643 A * 12/1998 Katsuyama ..... 347/8

FOREIGN PATENT DOCUMENTS

JP 6164477 A * 4/1986 ..... B41J/15/00
JP 63-240546 10/1988
JP 2-73354 3/1990
JP 8-310110 11/1996
JP 8-310113 11/1996

OTHER PUBLICATIONS

Frank Cost, Pocket Guide to Digital Printing, 1997, Thomson Learning, Chapter 5, pp. 79–110.*

* cited by examiner

*Primary Examiner*—Craig Hallacher
*Assistant Examiner*—Blaise Mouttet
(74) *Attorney, Agent, or Firm*—McGuireWoods LLP

(57) ABSTRACT

An ink jet printer forms an image frame in a continuous recording sheet at a size PL with reference to a feeding direction. The continuous recording sheet includes plural recording sheets, and a splicing portion for splicing the plural recording sheets to one another in one line. In ink jet printing, the image frame is printed to the continuous recording sheet with a printing bead while the continuous recording sheet is fed in the feeding direction. It is detected whether the splicing portion comes past a predetermined position upstream from the printing head at a distance L1. The printing head is inhibited from printing the image frame if an unavailable region including the splicing portion is estimated to overlap on a region of the image frame according to a detection signal from the detecting step.

22 Claims, 10 Drawing Sheets

INK JET PRINTER, INK JET PRINTING METHOD AND CONTINUOUS RECORDING SHEET

BACKGROUND OF THE INVENTION

1. Field of the Invention

The present invention relates to an ink jet printer, an ink jet printing method and a continuous recording sheet. More particularly, the present invention relates to an ink jet printer and an ink jet printing method in which a roll of a continuous recording sheet is used, and portions in the continuous recording sheet where images cannot be recorded with high quality can be prevented from being used for printing, and a continuous recording sheet for use therein.

2. Description Related to the Prior Art

An ink jet printer is known, and includes an ink jet printing head. The ink jet printer is used with recording material any of plural types, which include a sheet or card in a limited size, and a continuous recording sheet with a great length. The continuous recording sheet is supplied in a form of a sheet roll. The use of the sheet roll is effective in printing an image frame efficiently and quickly.

To produce the roll type of the continuous recording sheet, the continuous recording sheet is obtained by cutting at a predetermined great length. In manufacturing lines for the continuous recording sheet, there occur a great number of recording sheet strips with relatively small lengths under the predetermined great length at respective manufacturing lots. Although the recording sheet strip has as high quality as the continuous recording sheet by way of a product, the recording sheet strip cannot be used as product because of the insufficient lengths. The recording sheet strip must be discarded as waste, which is inconsistent to reducing the manufacturing cost.

To elongate the recording sheet strip, it is conceivable to splice two recording sheet strips to one another. However, splicing causes a thickness of the continuous recording sheet to become greater because adhesive agent or adhesive tape has its own thickness. Also, a stepped shape occurs at a splicing portion in the continuous recording sheet. It is impossible to print the image frame at the splicing portion with high quality. It is general in the ink jet printer that a gap between the printing head and the recording sheet strip is as small as 1 mm. It is likely that the splicing portion contacts and interferes with the continuous recording sheet at the gap, to cause jamming of the continuous recording sheet, damages of the printing head and other serious problems.

SUMMARY OF THE INVENTION

In view of the foregoing problems, an object of the present invention is to provide an ink jet printer and ink jet printing method in which a roll of a continuous recording sheet is used, and portions in the continuous recording sheet where images cannot be recorded with high quality can be prevented from being used for printing, and a continuous recording sheet for use therein.

Another object of the present invention is to provide an ink jet printer and ink jet printing method in which interference of a continuous recording sheet with a printing head can be prevented, and a continuous recording sheet for use therein.

In order to achieve the above and other objects and advantages of this invention, an image frame is formed in a continuous recording sheet at a size PL with reference to a feeding direction of the continuous recording sheet. The continuous recording sheet includes plural recording sheets, and a splicing portion for splicing the plural recording sheets to one another in one line. In an ink jet printing method, the image frame is printed to the continuous recording sheet with a printing head while the continuous recording sheet is fed in the feeding direction. It is detected whether the splicing portion comes past a predetermined position upstream from the printing head at a distance L1. The printing head is inhibited from printing the image frame if an unavailable region including the splicing portion is estimated to overlap on a region of the image frame according to a detection signal from the detecting step.

In a preferred embodiment, $PL \leqq L1 \leqq 2PL$.

Furthermore, a printer forms an image frame in a continuous recording sheet at a size PL with reference to a feeding direction of the continuous recording sheet. In the printer, a feeder mechanism feeds the continuous recording sheet in the feeding direction. A printing head prints the image frame to the continuous recording sheet being fed. A splice sensor is disposed upstream from the printing head at a distance L1, for detecting the splicing portion, where $L \geqq PL$. A controller inhibits the printing head from printing a succeeding second image frame if the splice sensor detects the splicing portion before completion of printing of one first image frame.

The plural recording sheets include material having porosity.

The controller causes the continuous recording sheet to move until the splicing portion comes past the printing head, and then allows printing of the second image frame.

Furthermore, a cutter cuts away the splicing portion from a first recording sheet where the first image frame is positioned in the continuous recording sheet, and from a second recording sheet where the second image frame is positioned in the continuous recording sheet.

The cutter is disposed upstream from the printing head in the feeding direction.

In a preferred embodiment, the cutter is disposed downstream from the printing head in the feeding direction.

Furthermore, a shifter mechanism shifts one of the printing head and the continuous recording sheet from remainder thereof while the splicing portion moves past the printing head, to prevent the printing head from interfering with the splicing portion.

The shifter mechanism includes at least two shifter rollers, disposed upstream and downstream from the printing head, for being rotated and for shifting the continuous recording sheet away from the printing head.

The continuous recording sheet includes splicing information, positioned with the splicing portion, for representing the splicing portion. The splice sensor detects the splicing portion by reading the splicing information.

The splicing information comprises a splicing indicia.

In another preferred embodiment, the splicing information is constituted by a through hole.

In still another preferred embodiment, the splice sensor is constituted by a thickness measurer for detecting a thickness of the continuous recording sheet. The controller detects the splicing portion by comparing the thickness with a reference thickness.

The splicing portion includes adhesive agent for attaching the plural recording sheets to one another.

In another preferred embodiment, the splicing portion includes an adhesive tape for attaching the plural recording sheets to one another.

The plural recording sheets include a support material. A resin layer is formed on at least one surface of the support material, overlapped with one other recording sheet, and adapted to ultrasonic welding for splicing.

According to another aspect of the invention, an image frame is formed in a continuous recording sheet at one of sizes PL and HL with reference to a feeding direction of the continuous recording sheet, where PL>HL. In an ink jet printing method, the image frame is printed to the continuous recording sheet with a printing head while the continuous recording sheet is fed in the feeding direction. While the continuous recording sheet is fed, the splicing portion is detected in a predetermined position upstream from the printing head in the feeding direction. The printing head allowed to print the image frame irrespective of the sizes PL and HL if an unavailable region including the splicing portion is estimated to come outside or come adjacent to an image frame region having the size PL according to a detection signal from the detecting step, wherein the printing head is allowed to print the image frame having the size HL in inhibiting the printing head from printing the image frame having the size PL if the unavailable region is estimated to overlap on the image frame region having the size PL according to the detection signal, and wherein the printing head is inhibited from printing the image frame having the size HL if the unavailable region is estimated to overlap on an image frame region having the size HL according to the detection signal.

Furthermore, a printer forms an image frame in a continuous recording sheet at one of sizes PL and HL with reference to a feeding direction of the continuous recording sheet, where PL>HL. In the printer, a feeder mechanism feeds the continuous recording sheet in the feeding direction. A printing head prints the image frame to the continuous recording sheet being fed. A splice sensor is disposed in a predetermined position upstream from the printing head in the feeding direction, for detecting the splicing portion while the continuous recording sheet is fed. A length measurer measures a sheet feeding amount of the continuous recording sheet in the feeding direction with reference to a detection signal from the splice sensor. A controller is operated in response to completion of printing one preceding image frame, for obtaining a distance D in the feeding direction between the printing head and the splicing portion upstream therefrom according to the sheet feeding amount, for comparing the distance D with the size PL, for, if PL≦D, allowing the printing head to print the image frame irrespective of the sizes PL and HL, for, if D<PL, comparing the distance D with the size HL in inhibiting printing of the image frame at the size PL, for, if HL≦D, allowing the printing head to print the image frame at the size HL, and for, if D<HL, inhibiting printing of the image frame at the size HL.

The controller, if D<HL, causes the continuous recording sheet to move until the splicing portion comes past the printing head, and then allows printing of the image frame irrespective of the sizes PL and HL.

The controller, if HL≦D<PL, adjusts an order of information of image frames to set an image frame of the size HL with priority over the image frame of the size PL, and drives the printing head according thereto.

According to still another aspect of the invention, a continuous recording sheet of a roll form includes plural recording sheets adapted to ink jet printing. A splicing portion splices the plural recording sheets to one another in one line.

The plural recording sheets include material having porosity.

Furthermore, splicing information is positioned with the splicing portion, for representing the splicing portion.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
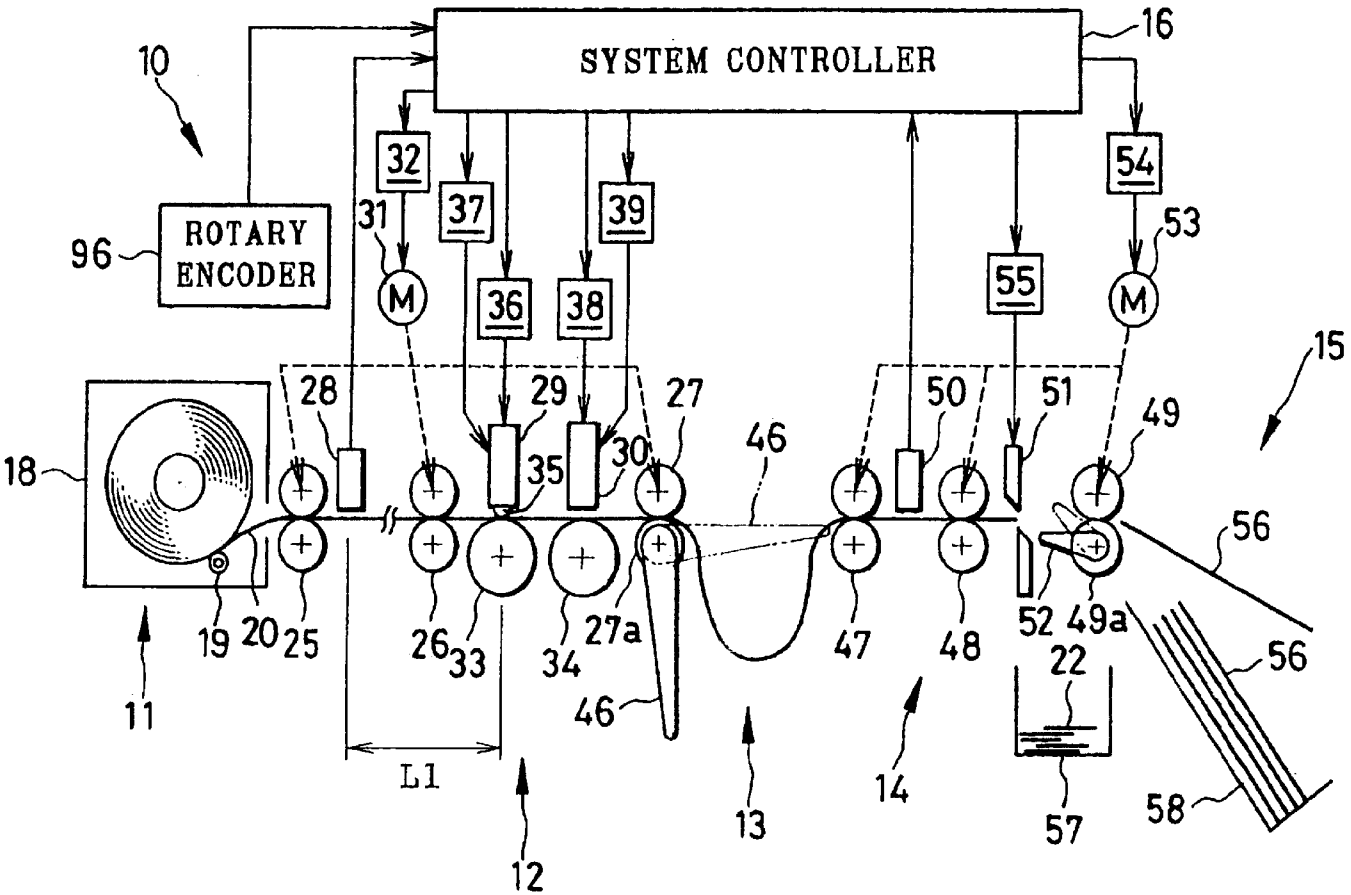
FIG. 1 is an explanatory view illustrating an ink jet printer.

In FIG. 1, an ink jet printer 10 of the invention is illustrated, and includes a supply unit 11, an image forming unit 12, a recording material reservoir 13, a cutter 14, a sorter 15 and a system controller 16. A recording material magazine 18 is used with the supply unit 11, and includes a supply roller 19. The supply unit 11 causes the supply roller 19 to rotate. So continuous recording sheet 20 is unwound and fed from the recording material magazine 18.

Figure 2:
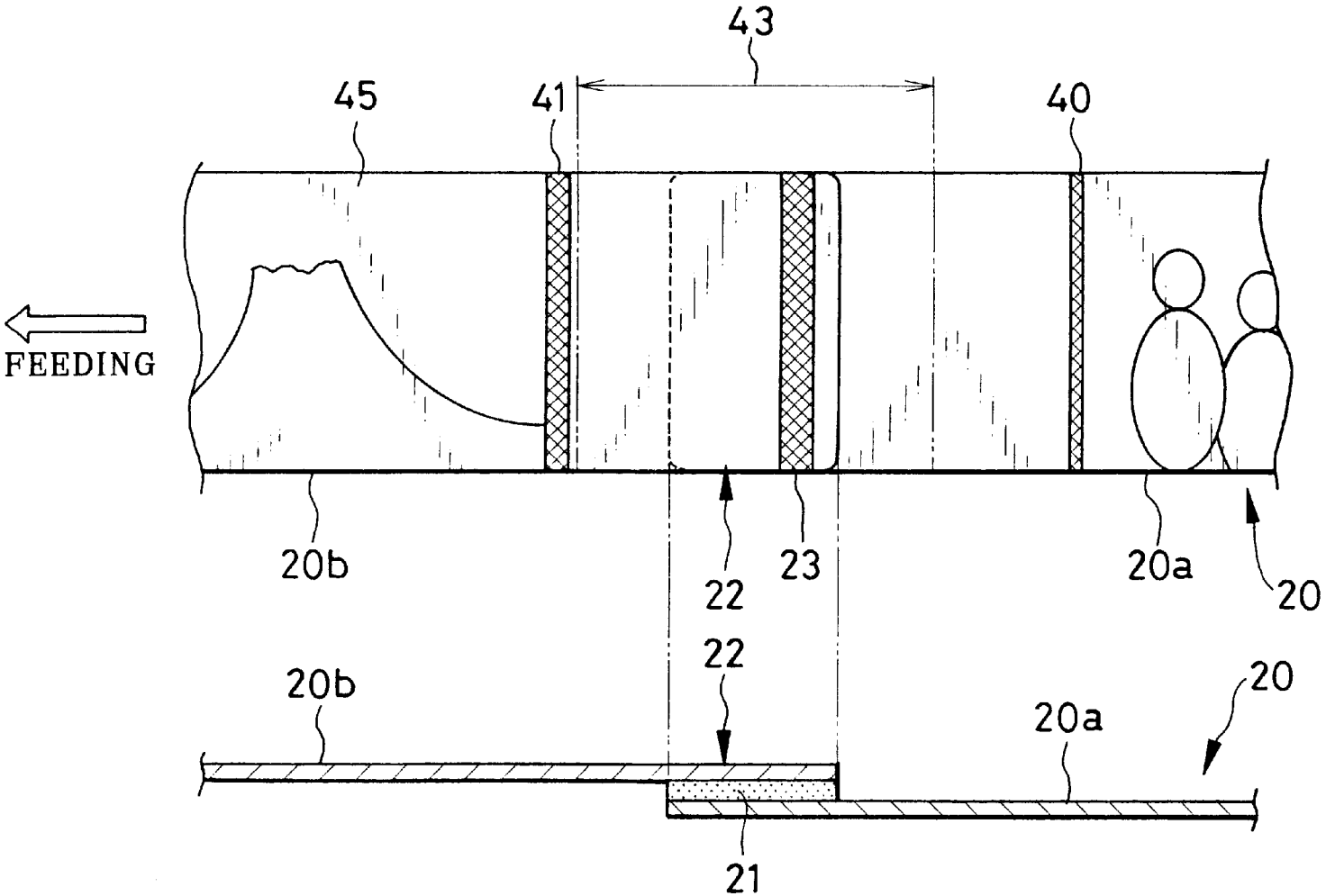
FIG. 2 is an explanatory view illustrating ends of two recording sheet strips and a splicing portion.

In FIG. 2, the continuous recording sheet 20 is constituted by a train of plural recording sheet strips 20*a* and 20*b*, and a splicing portion 22 for connecting the recording sheet strip 20*a* to the recording sheet strip 20*b*. The splicing portion 22 is provided with adhesive agent 21 for attaching an end of the recording sheet strip 20*a* to an end of the recording sheet strip 20*b*. A splicing indicia 23 as splicing information is prerecorded to the end of each of the recording sheet strips 20*a* and 20*b* by recording operation in a manufacturing process, and informs existence of the splicing portion 22. Splicing by use of the adhesive agent 21 is effective in utilizing the recording sheet strips 20*a* and 20*b* created with an irregular size from respective lots in the manufacture, to lower the cost of the continuous recording sheet 20. The splicing indicia 23 has a width different from that of a cutting indicia or sorting indicia which will be described later, for the purpose of preventing misreading of indicia.

Figure 10:
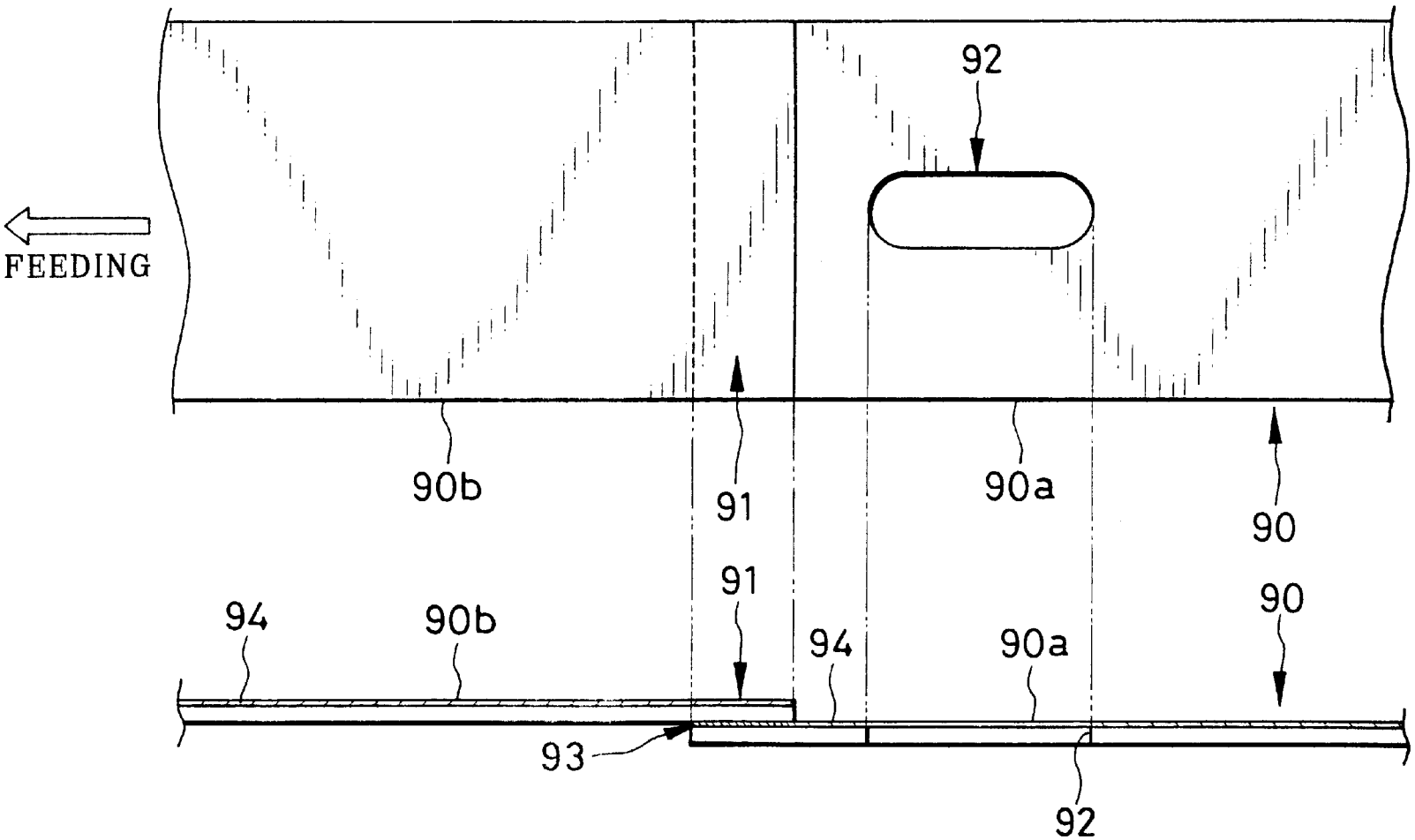
FIG. 10 is an explanatory view illustrating ends of two recording sheet strips and a splicing portion according to still another preferred embodiment.

Note that positions of preprinting the splicing indicia 23 may be changed in any suitable manner. Also, the splicing indicia 23 may be constituted by a cutout or hole. An example of the hole is described in ISO, TC42/WG8. In FIG. 10, a through hole 92 as splicing information is formed in continuous recording sheet 90 and disposed at a predetermined distance from a splicing portion 91. Furthermore, for the purpose of detecting the splicing portion 22, it is possible to detect a difference in the thickness between the splicing portion 22 and portions other than the splicing portion 22 by use of a thickness measurer.

In FIG. 1, the image forming unit 12 includes feeder roller sets 25, 26 and 27 as feeder mechanism, a splice sensor 28, a thermal head 29 and an inkjet printing head 30. A motor 31 causes the feeder roller sets 25–27 to rotate, so that the continuous recording sheet 20 is fed at a regular speed. A motor driver 32 is connected with the system controller 16 to rotate the motor 31. The splice sensor 28, the thermal head 29 and the printing head 30 are arranged in the feeding direction between the feeder roller sets 25, 26 and 27.

The splice sensor 28 detects the splicing indicia 23 in the continuous recording sheet 20, and sends a detection signal to the system controller 16. The splice sensor 28 is positioned at a distance L1 from the thermal head 29, the distance L1 being longer than the size PL of the image in the feeding direction. This makes it possible to check whether the splicing portion 22 exists in a region of an image frame before printing. The thermal head 29 and the printing head 30 are disposed to extend in a main scan direction that is crosswise to feeding of the continuous recording sheet 20. Platen rollers 33 and 34 are disposed under the thermal head 29 and the printing head 30, and support the continuous recording sheet 20 being fed.

An array of heating elements 35 is included in the thermal head 29. A shifter mechanism 36 moves the thermal head 29 up and down, and while the splicing portion 22 moves past the thermal head 29, keeps the thermal head 29 in a retracted position higher than the feeding path. In printing an image, the shifter mechanism 36 shifts the thermal head 29 down and positions the same in the feeding path. A thermal head driver 37 is controlled by the system controller 16 and drives the heating elements 35. When the printing head 30 operates for printing, the thermal head 29 is set down and squeezes the continuous recording sheet 20 between it and the platen roller 33 to preheat the continuous recording sheet 20. The preheating is effected to dry the ink quickly on the continuous recording sheet 20 after ejection from the printing head 30. Heat energy applied by the heating elements 35 in the thermal head 29 is determined according to an amount of the ink ejected by the printing head 30 for each of pixels.

A shifter mechanism 38 supports the printing head 30 in a manner movable up and down. The printing head 30 is set away from the feeding path while the splicing portion 22 is moved past the printing head 30. In printing an image, the shifter mechanism 38 moves down the printing head 30 and sets the same in a printing position.

The printing head 30 includes arrays of nozzles for line recording of yellow, magenta, cyan and black colors, the arrays extending in the main scan direction crosswise to the feeding direction. The printing head 30 includes piezoelectric elements disposed in an ink flowing path close to the nozzles. The ink flowing path is shortened or extended by the piezoelectric elements, to eject and supply ink. A printing head driver 39 sends a drive signal to each of piezoelectric elements according to image data. Ink droplets are ejected and deposited to the continuous recording sheet 20 at sizes and in a number according to the image data. A full-color image is recorded to the continuous recording sheet 20 with ink of yellow, magenta, cyan and black colors. Furthermore, the printing head 30 prints a cutting indicia 40 and a sorting indicia 41 between image frames. See FIG. 2. The cutting indicia 40 is adapted to cutting of the continuous recording sheet 20 per image frame at the cutter 14 in a downstream position. The sorting indicia 41 is adapted to sorting obtained prints by means of the sorter 15.

Figure 3:
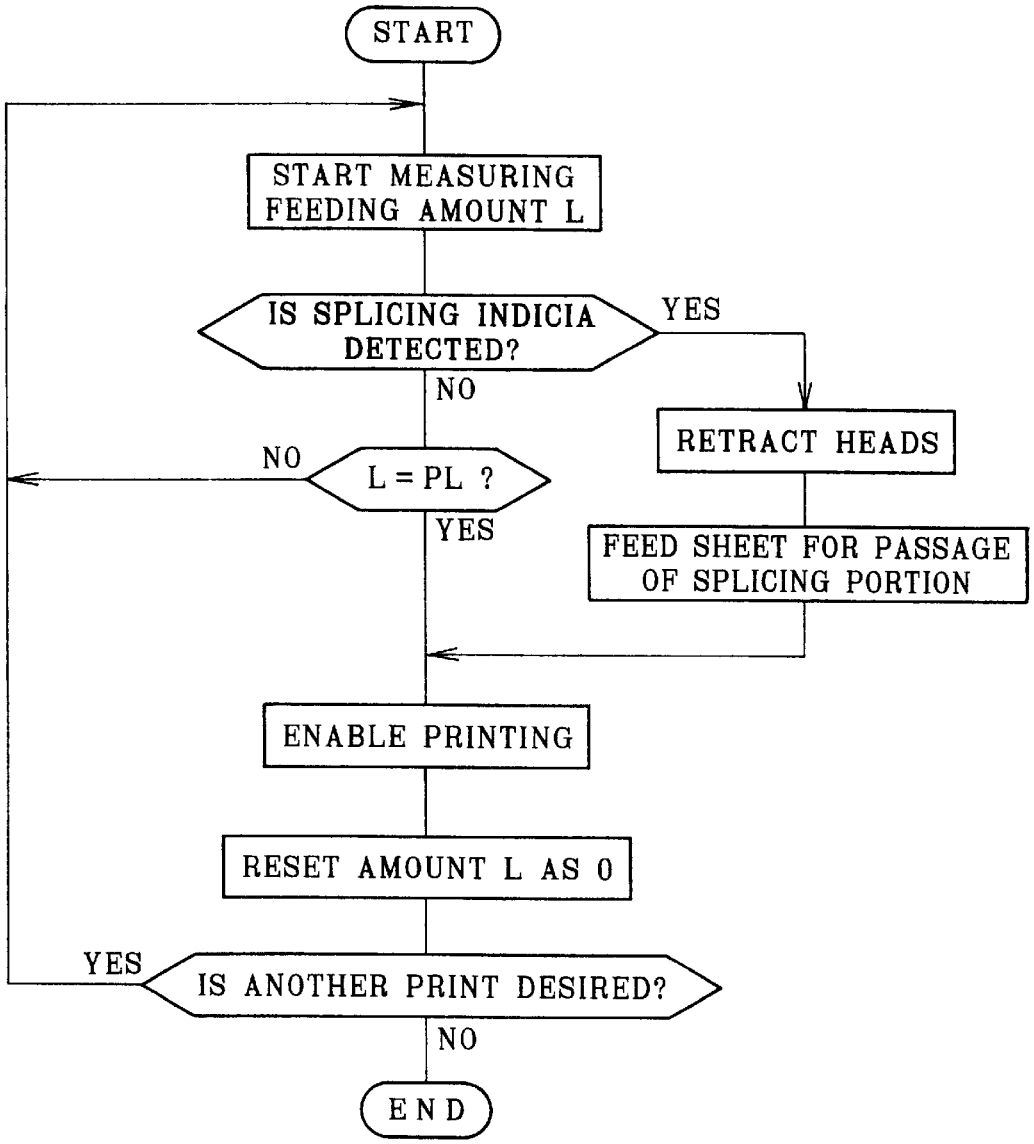
FIG. 3 is a flow chart illustrating a process of passage of the splicing portion at a printing head.

The system controller 16 controls various elements of the printer for feeding of the continuous recording sheet 20 and printing an image. As illustrated in FIG. 3, the system controller 16 monitors passage of the splicing indicia 23 according to a signal from the splice sensor 28 while the continuous recording sheet 20 passes. If the splicing indicia 23 is not detected during feeding of the continuous recording sheet 20 by an amount of the size PL of one image frame, then it is detected that an image frame can be safely printed to the continuous recording sheet 20. A printing enable signal is generated to effect a printing operation. If the splicing indicia 23 is detected during feeding of the continuous recording sheet 20 by an amount smaller than the size PL of one image frame, then it is detected that a region of an image frame will be overlapped on an unavailable region 43 depicted in FIG. 2. For this situation, the shifter mechanisms 36 and 38 keep the thermal head 29 and the printing head 30 shifted up while the unavailable region 43 moves past the thermal head 29 and the printing head 30. After the unavailable region 43 passes the printing head 30, a printing enable signal is generated to print another image frame.

Note that a rotary encoder 96 monitors a rotational amount of the motor 31 and sends a pulse to the system controller 16 for the purpose of measuring a feeding amount of the continuous recording sheet 20 by means of the feeder roller sets 25–27 as length measurer. Also, the size PL according to the embodiment is the maximum size of a printable image frame. This is because any image frame, if in a size equal to or smaller than the size PL, can be printed as desired.

Ink stuck to the continuous recording sheet 20 is dried at a short time because the continuous recording sheet 20 has been preheated by the thermal head 29. There is no sticking of ink of the continuous recording sheet 20 to the feeder roller set 27. There is no contamination of the continuous recording sheet 20 with the ink. As the ink is dried at a short time, there occurs no local extension of the continuous recording sheet 20 due to absorption.

The reservoir 13 is constituted by the feeder roller set 27 in the image forming unit 12, a movable guide plate 46, and a feeder roller set 47 in the cutter 14. The reservoir 13 operates by driving the feeder roller set 27 at a higher speed than the feeder roller set 47 of which the speed is equal to or higher than zero, and reserves a portion of the continuous recording sheet 20 between the feeder roller set 27 and the feeder roller set 47. The movable guide plate 46 is pivotally movable about an axis about which a lower roller 27*a* of the feeder roller set 27 rotates. The movable guide plate 46 rotates between first and second positions, and when in the first position indicated by the phantom line, guides a front end of the continuous recording sheet 20 to the feeder roller set 47 in the cutter 14, and when in the second position indicated by the solid line, is positioned to extend vertically. While the movable guide plate 46 is in the second position, a portion of the continuous recording sheet 20 is suspended in a looped shape, and reserved in a temporary manner.

The cutter 14 is constituted by the feeder roller set 47, feeder roller sets 48 and 49 as feeder mechanism, an indicia sensor 50, cutter blades 51 and a separation guide plate 52. A motor 53 rotates the feeder roller sets 47–49. A motor driver 54 is connected with the system controller 16. A cutter driver 55 is connected with the system controller 16, and causes the cutter blades 51 to move. The separation guide plate 52 is pivotally movable about an axis about which a lower roller 49*a* of the feeder roller set 49 rotates. The separation guide plate 52 rotates between first and second positions, and when in the first position indicated by the solid line, guides a print 56 to the feeder roller set 49 after cutting frame by frame, and when in the second position indicated by the phantom line, guides the splicing portion 22 to an ejection case 57.

The system controller 16, upon receiving detection signals from the indicia sensor 50 in relation to the cutting indicia 40, the sorting indicia 41 and the splicing indicia 23, controls the motor 53 by means of the motor driver 54, and sets the frame borderlines of the continuous recording sheet 20 and the splicing portion 22 at the cutter blades 51. Then the cutter blades 51 cut the portions of frame borderlines of the continuous recording sheet 20 and front and rear portions of the splicing portion 22. When the cutting indicia 40 or the sorting indicia 41 is detected, the separation guide plate 52 is set in the first position for guiding. The print 56 is guided by the feeder roller set 49 and fed to the sorter 15. When the splicing indicia 23 is detected, the separation guide plate 52 is set in the second position for abandonment. The splicing portion 22 cut from the continuous recording sheet 20 is discarded into the ejection case 57.

A great number of trays 58 are arranged on a conveyor belt (not shown). According to a detection signal from the indicia sensor 50 in response to the sorting indicia 41, the system controller 16 drives the conveyor belt by an amount of the pitch of the trays 58. Thus a new one of the trays 58 is set to a position of drop of prints. After cutting, the prints 56 are sorted in each of the trays 58 in a collective manner.

Operation of the above construction is described now. When the ink jet printer 10 is turned on, the supply roller 19 and the feeder roller sets 25–27 are rotated to feed the continuous recording sheet 20 to the image forming unit 12. The thermal head 29 and the printing head 30 are kept retracted and allows the front end of the continuous recording sheet 20 to pass safely. When the front end passes the feeder roller set 27, feeding of the continuous recording sheet 20 is discontinued to stand by for printing.

When a printing key is depressed to start printing, the shifter mechanisms 36 and 38 set the thermal head 29 and the printing head 30 to their operating positions. After this, the continuous recording sheet 20 is preheated by the heating elements 35 at an amount according to the image data of the image to be printed. The printing head driver 39 controls the nozzles of the printing head 30, so nozzles eject ink droplets according to the image data, to print the image by inkjet printing. Upon printing one line, the continuous recording sheet 20 is fed by an amount of one line, to print another line. Therefore, the image is printed line after line, to obtain a printed image of one image frame.

When the splicing indicia 23 is detected, the system controller 16 determines the unavailable region 43 disposed to include the splicing portion 22 as unavailable for printing of an image. See FIG. 2. Then the thermal head 29 and the printing head 30 are set in their retracted positions. The continuous recording sheet 20 is fed at a predetermined amount to move the unavailable region 43 downstream beyond the printing head 30. Upon completion of feeding of the continuous recording sheet 20, the thermal head 29 and the printing head 30 are set in their operating position. An image frame 45 illustrated in FIG. 2 is printed to the continuous recording sheet 20.

The cutting indicia 40 is printed by the printing head 30 at each of borderlines between image frames as depicted in FIG. 2. Also, the sorting indicia 41 is printed by the printing head 30 at each of borderlines between customers requests for printing. When the indicia sensor 50 detects the cutting indicia 40 in the section of the cutter 14, portions along borderlines of the images are positioned at the cutter blades 51, to cut away the portions including the cutting indicia 40. When the indicia sensor 50 detects the sorting indicia 41, image frames are cut away from one another in the same manner as the cutting indicia 40, and also a sorting signal is sent to the sorter 15 to set the trays 58 in the position of drop of prints. Finally, all images are printed. A front edge of the continuous recording sheet 20 is moved back to the feeder roller set 27 of the image forming unit 12, and becomes ready for printing operation.

In the above embodiments, the thermal head 29 and the printing head 30 are set in their retracted positions upon detection of the splicing indicia 23. The splicing portion 22 is caused to pass. After printing, the splicing portion 22 is cut away with border portions beside the image frame. In contrast, it is possible to print an image after cutting away the splicing portion 22.

Figure 4:
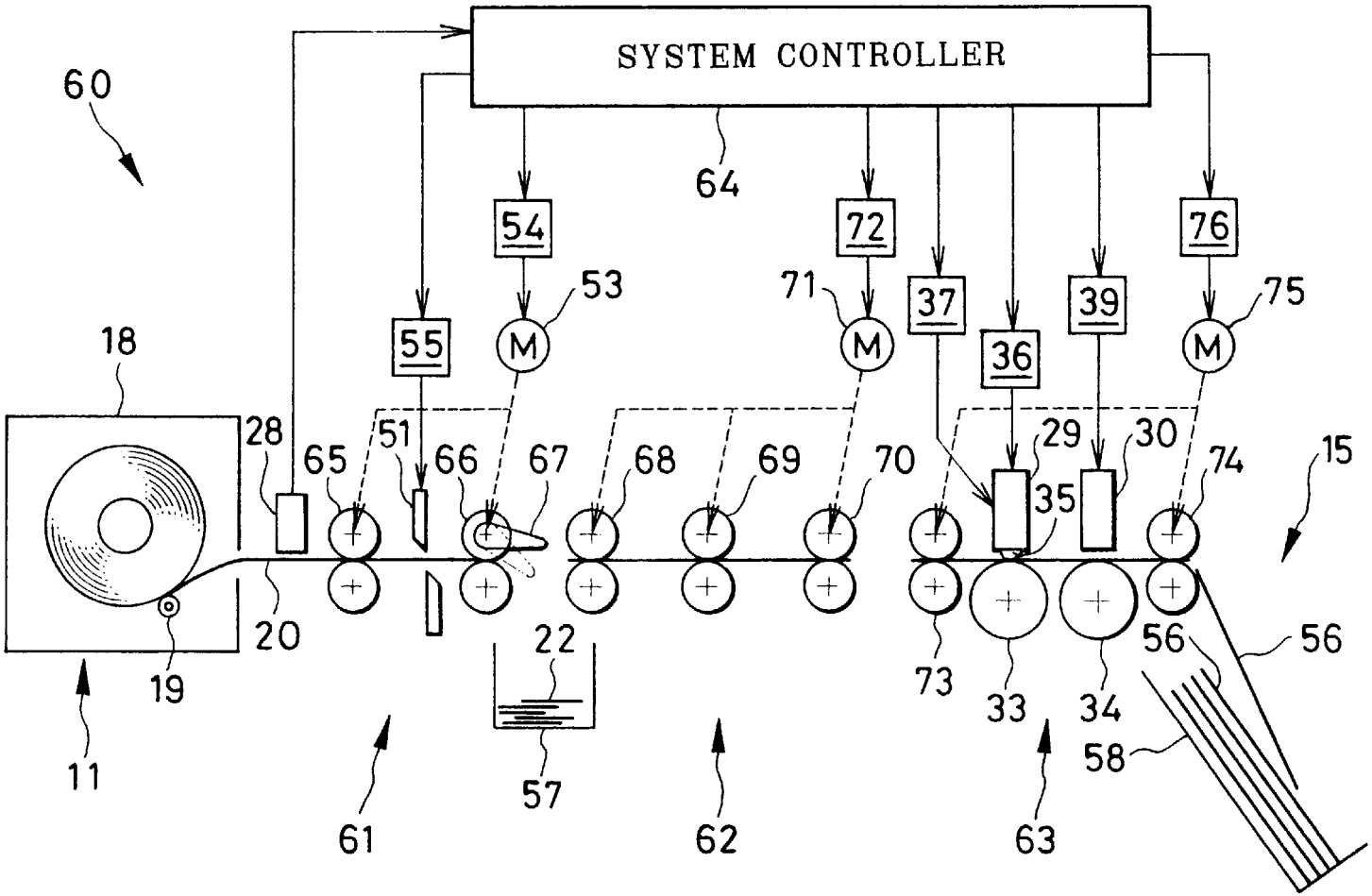
FIG. 4 is an explanatory view illustrating another preferred ink jet printer in which a cutter cuts the recording sheet before printing.

A preferred embodiment is depicted in FIG. 4. An ink jet printer 60 includes the supply unit 11, a cutter 61, a buffer feeder unit 62, an image forming unit 63, the sorter 15, a system controller 64 and a plurality of feeder roller sets 65, 66, 68, 69, 70, 73 and 74. A motor 53 rotates the feeder roller sets 65 and 66, and a motor driver 54 is connected with the system controller. Similarly, a motor 71 rotates the feeder roller sets 68–70 and a motor driver 72 is connected between the motor 71 and the system controller. Additionally, a motor 75 rotates the feeder roller sets 73 and 74 with motor driver 76 connected with the system controller. A separation guide plate 67 is pivotally movable about an axis about which an upper roller of the feeder roller set 66 rotates. The splice sensor 28 is disposed upstream from the cutter 61. A separation guide plate 67 is pivotally movable about an axis about which an upper roller of a feeder roller set 66 rotates. The separation guide plate 67 rotates between first and second positions, and when in the first position indicated by the solid line, guides the continuous recording sheet 20 to the buffer feeder unit 62 after cutting frame by frame, and when in the second position indicated by the phantom line, guides the splicing portion 22 to the ejection case 57.

Figure 5:
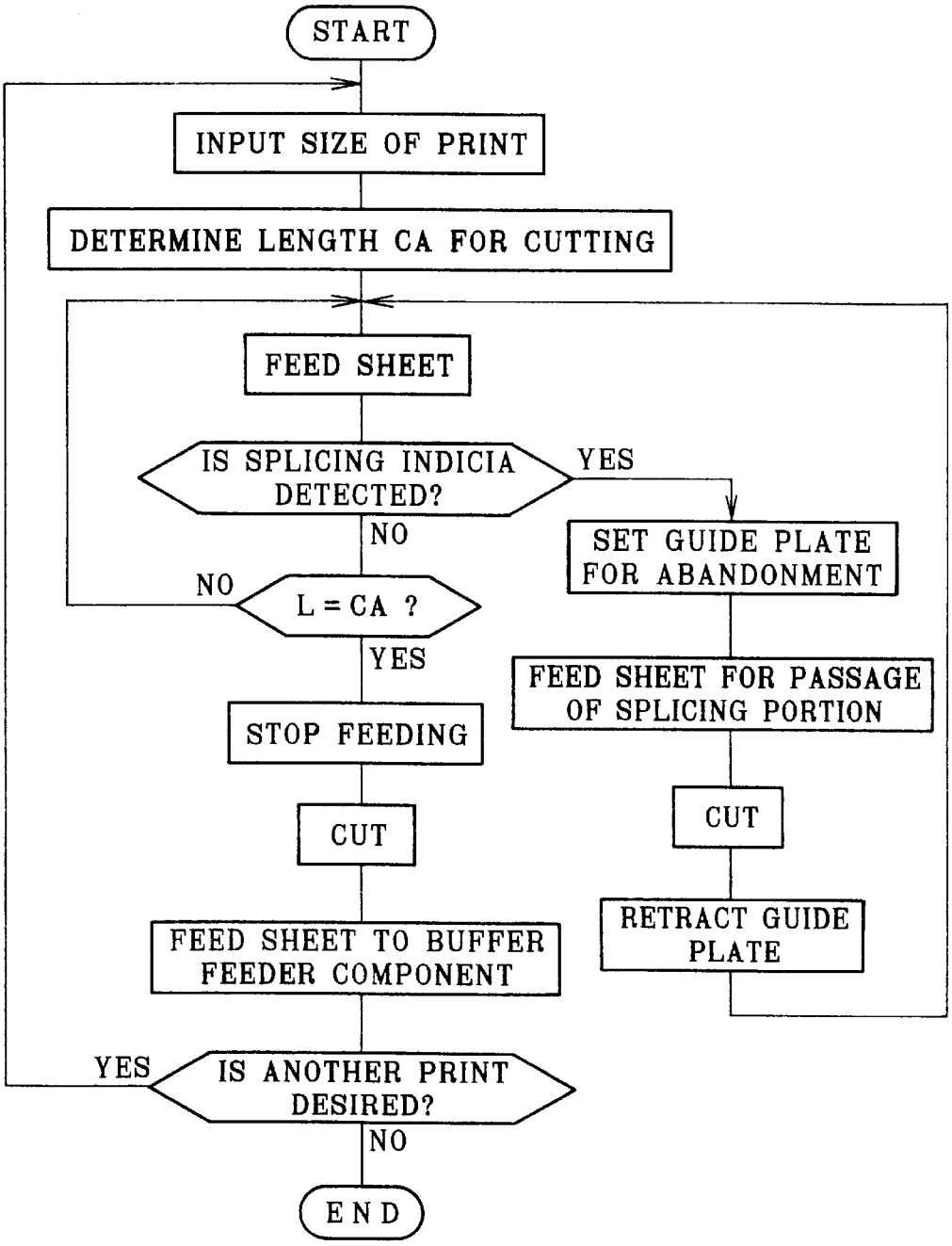
FIG. 5 is a flow chart illustrating a process of cutting the splicing portion in the printer of FIG. 4.

FIG. 5 is a flow chart of a flow of cutting the splicing portion 22 in the ink jet printer 60. When information of a printing size of an image frame is input, a size CA of cutting the continuous recording sheet 20 is determined so feed the continuous recording sheet 20 suitably. In response to detection of the splicing indicia 23 by the splice sensor 28, the separation guide plate 67 is set at the second position for abandonment. The continuous recording sheet 20 is fed at an amount to move the splicing portion 22 to a position past the cutter blades 51. Then the splicing portion 22 is cut away and discarded into the ejection case 57. After the splicing portion 22 is cut away, the separation guide plate 67 is set in the first position to feed the continuous recording sheet 20 again. If the splicing indicia 23 is not detected, then the continuous recording sheet 20 is fed by the amount equal to the determined cutting size CA, and cut. The continuous recording sheet 20 is sent to the buffer feeder unit 62.

In the above embodiment, the printer is a line printer in which an image is printed one line after another in the continuous recording sheet 20. Also, the printer can be a serial printer which has an ink jet printing head extending in a main scan direction, and a head carriage for moving the ink jet printing head in a sub scan direction being crosswise to the longitudinal direction of the continuous recording sheet 20, and in which the continuous recording sheet 20 is fed in the main scan direction longitudinally.

Figure 6:
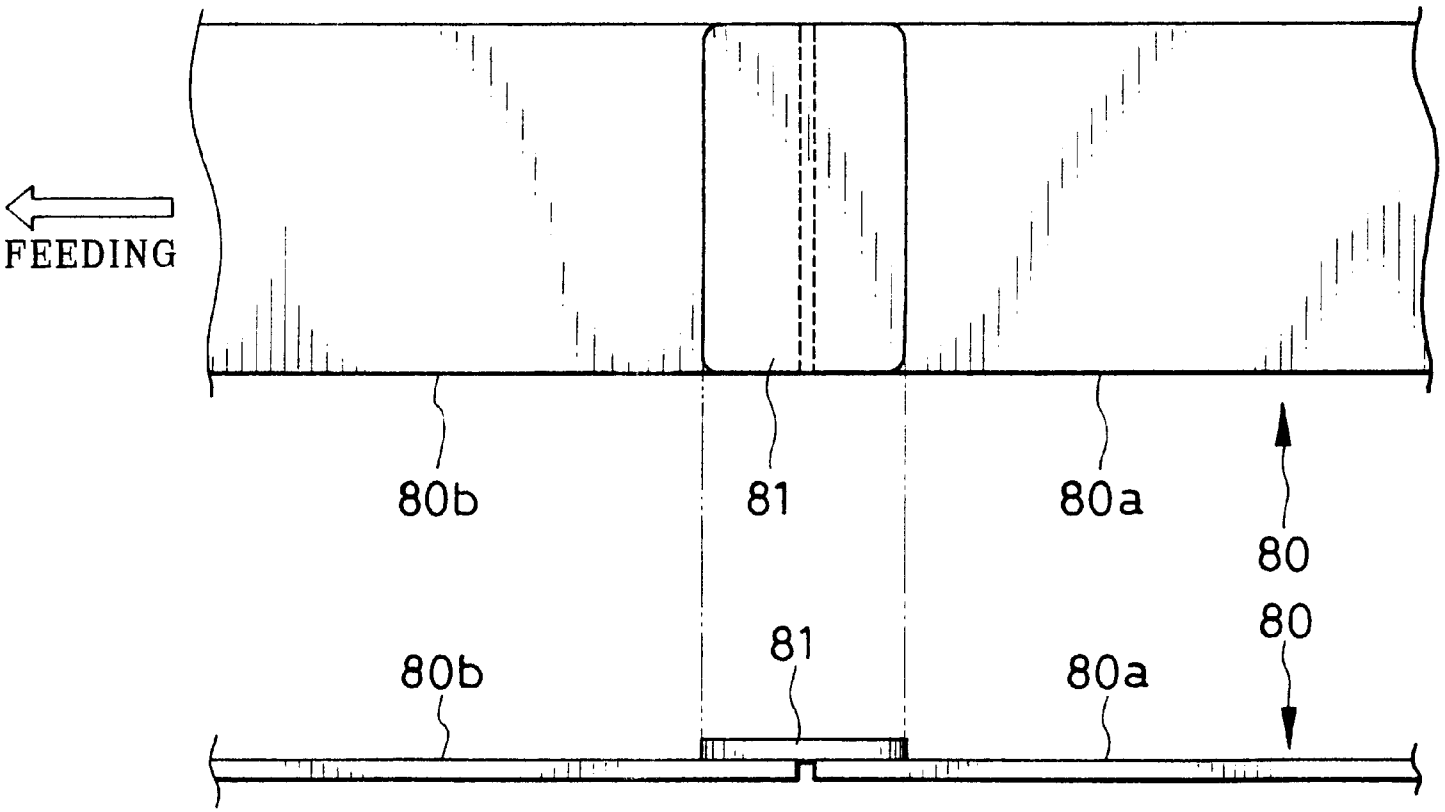
FIG. 6 is an explanatory view illustrating ends of two recording sheet strips and a splicing portion according to another preferred embodiment.

In the above embodiment, adhesive agent is used for splicing. However, a splicing tape 81 of FIG. 6 may be used for connecting ends of recording sheet strips 80 (80*a* and 80*b*) by adhesion. Note Y that ends of the recording sheet strips 80 are not overlapped on one another, but opposed to each other simply. Also, it is possible as depicted in FIG. 10 to use ultrasonic welding 93 for attaching recording strips 90 (90*a* and 90*b*) of recording sheet strips 90 to each other. A resin layer 94 of polyethylene for protection is formed as an upper layer of the recording sheet strips 90*a* and 90*b*, and adapted to the ultrasonic welding 93 upon application of ultrasonic waves.

Note that the ends of the recording sheet strips 80*a* and 80*b* may be overlapped on one another, and connected together by means of the splicing tape 81.

In the above embodiment, the thermal head 29 preheats the continuous recording sheet 20. Instead, the continuous recording sheet 20 may be heated immediately after printing an image. An air blow heater may be used to heat the continuous recording sheet 20.

Figure 7A:
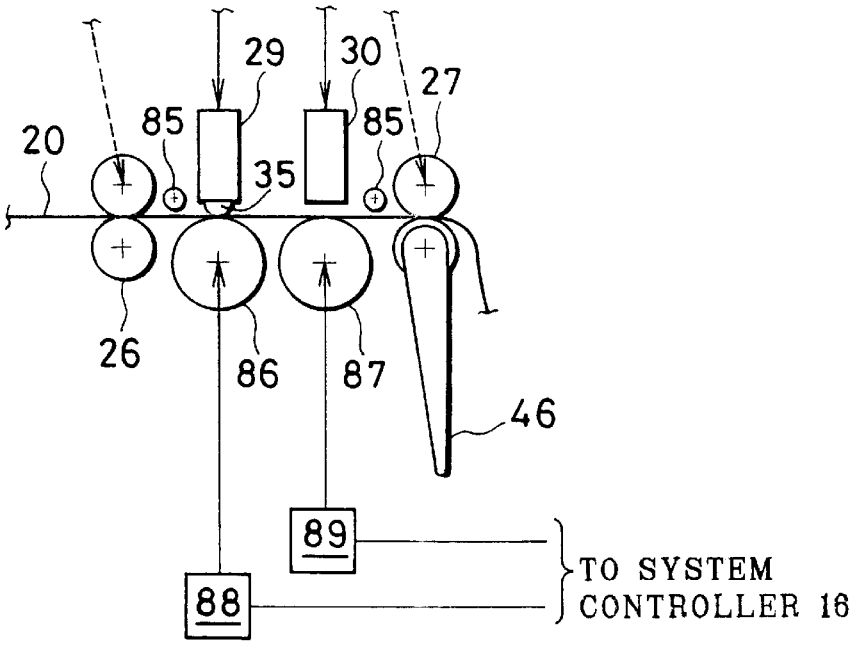
FIG. 7A is an explanatory view illustrating another preferred ink jet printer in which platen rollers are shiftable to pass the recording sheet.
Figure 7B:
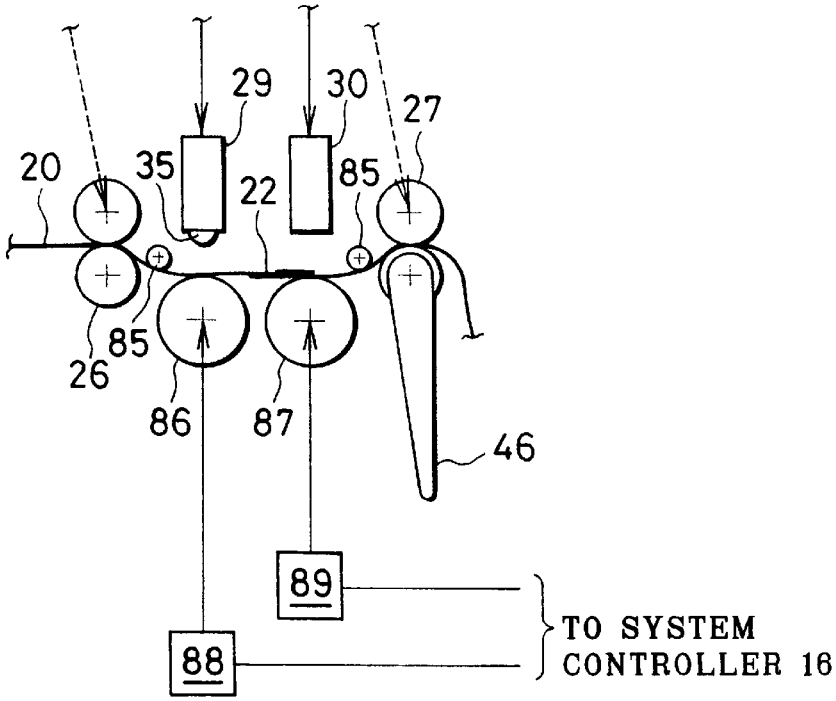
FIG. 7B is an explanatory view illustrating the same as FIG. 7A but in which platen rollers are shifted away from the recording sheet.

In the above embodiment, the printing head is retracted from the feeding path during passage of the splicing portion. FIGS. 7A and 7B illustrate another preferred embodiment in which the continuous recording sheet 20 can be shifted by shifter rollers 85. When the splicing portion 22 is moved past the printing head, shifter mechanisms 88 and 89 shift platen rollers 86 and 87 to retracted positions as illustrated in FIG. 7B. The shifter rollers 85 move to keep the splicing portion 22 away from the thermal head 29 and the printing head 30.

In the above embodiment, a remaining space directly after an image frame is evaluated in comparison with a single size of the image frame. Alternatively, a remaining space after an image frame may be evaluated in comparison with two sizes of image frames. Also, a sequence of plural image frames to be printed may be adjusted according to a result of the evaluation. A preferred embodiment to achieve those objects is hereinafter descried. Elements similar to those of the above embodiments are designated with identical reference numerals.

Figure 8:
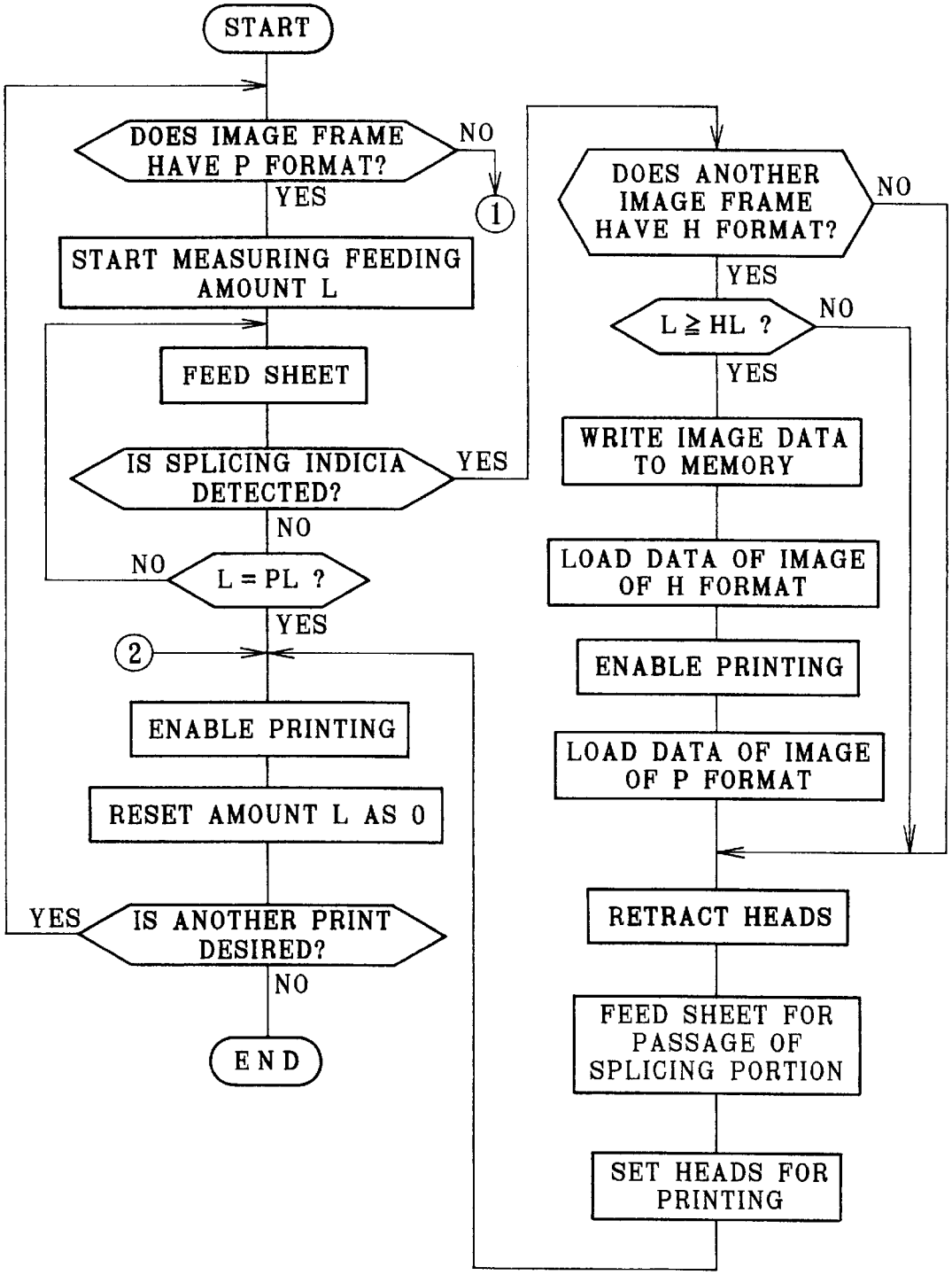
FIG. 8 is a flow chart illustrating a printing process of the ink jet printer.
Figure 9:
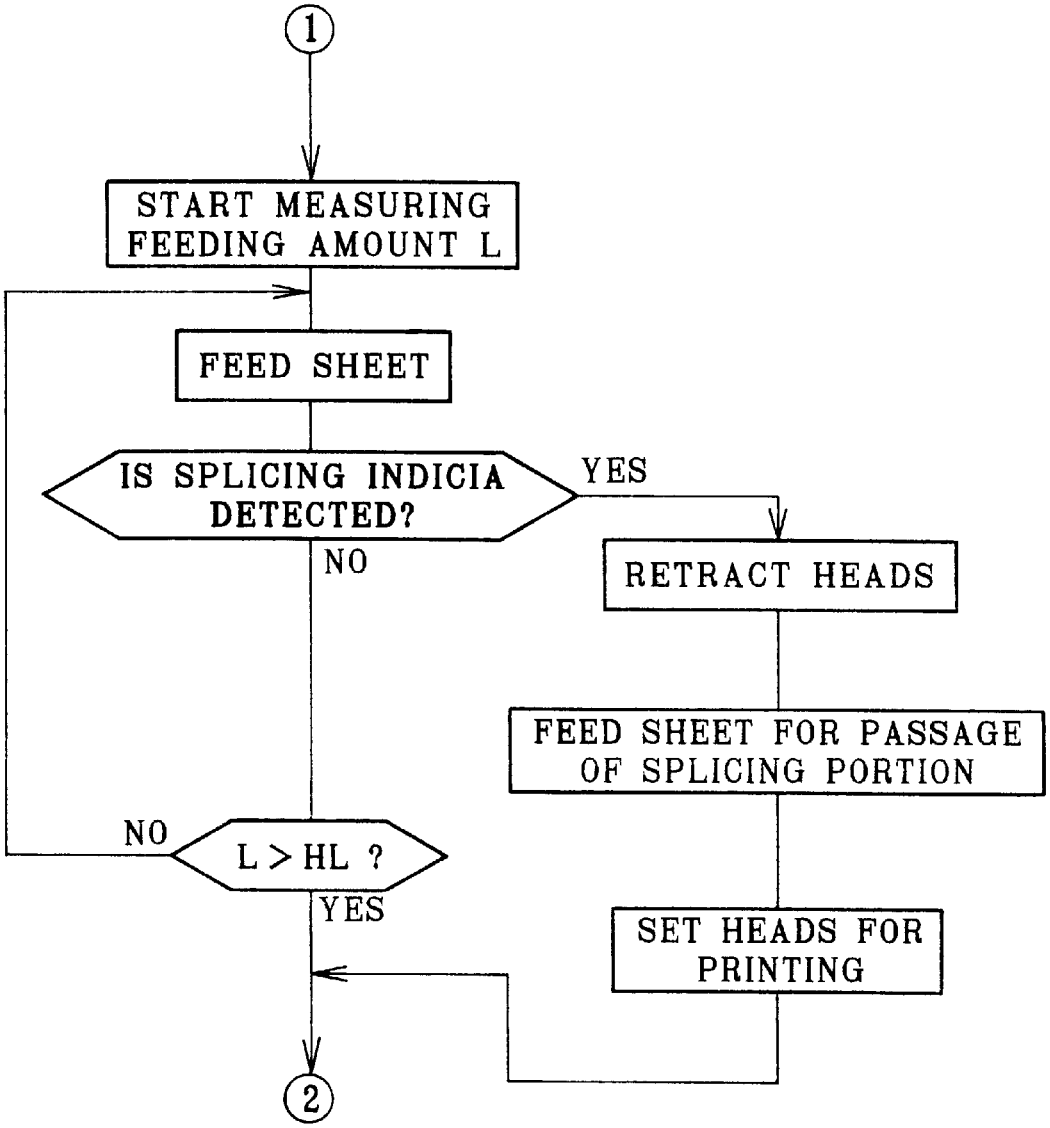
FIG. 9 is a flow chart illustrating a portion of the printing process particularly related to a situation where a print of a size HL is desired.

FIGS. 8 and 9 illustrate a flow of printing image frames of two formats including a P (panoramic) format and an H (HDTV or high-definition television) format.

At first, the system controller 16 recognizes the size of an image frame to be printed. The system controller 16 feeds the continuous recording sheet 20 by controlling the elements of the printer, and monitors passage of the splicing indicia 23 according to a signal generated by the splice sensor 28. If the image frame is in the P format, it is checked whether the splicing indicia 23 is detected while the continuous recording sheet 20 is fed at an amount equal to a size PL of the P format according to a signal from the rotary encoder 96. If the splicing indicia 23 is not detected, then printing of an image of the P format is allowed. A printing enable signal is generated to print the image.

If the splicing indicia 23 is detected while the continuous recording sheet 20 is fed at an amount smaller than the size PL of the P format, then it is detected that the image of the P format will overlap on the unavailable region 43. The system controller 16 checks whether the succeeding image frame to be printed has the H format of which a size HL is smaller than the size PL of the P format in the feeding direction.

If the image frame is in the H format, it is checked whether an amount L of feeding the continuous recording sheet 20 until detecting the splicing indicia 23 is equal to or greater than the size HL of the H format in the feeding direction. If the amount L is greater, printing of an image frame of the H format is allowed. Image data of the P format is written to a memory for reservation. Also, image data of the H format is read from the memory. A printing enable signal is generated to print the image of the H format.

When printing of the image of the H format is completed, image data of an image of the P format is read from the memory for reservation. The system controller 16 moves the continuous recording sheet 20 until the splicing portion comes past the printing head 30. When the unavailable region 43 comes past the printing head 30, a printing enable signal is generated to print an image of the P format.

If the amount L of feeding the continuous recording sheet 20 until detecting the splicing indicia 23 is smaller than the size HL of the H format, then the continuous recording sheet 20 is fed to move the unavailable region 43 past the printing head 30. After this, a printing enable signal is generated to print an image of the P format. At the initial step, if an image frame of the H format is to be printed, a process before printing operation is substantially the same as that for an image frame of the P format. See FIG. 9. It is concluded that the order of printing image frames is adjusted suitably in consideration of a size of a remaining space in the continuous recording sheet 20. The continuous recording sheet 20 can be used efficiently as a waste amount of the continuous recording sheet 20 can be reduced.

In the above embodiment, the rotary encoder 96 is used as length measurer. Alternatively, other structures for measuring a length or amount of feeding the continuous recording sheet 20 may be used. For example, a timer may be used to measure time during which the continuous recording sheet 20 is fed. The controller may obtain a feeding amount by multiplying the measured time by feeding speed of the continuous recording sheet 20. Furthermore, a stepping motor may be used to feed the continuous recording sheet 20 at an amount according to driving pulses of which the number is determined by the controller.

In the above embodiment, images of the P format and the H format are included in images according to one request for printing. Predetermined formats of images may be other than the P format and the H format. Also, three or more formats of images may be predetermined and used. In the above embodiment, the order of information of image frames is adjusted so as to set an image frame of the H format prior to an image frame of the P format if the remaining region has a size between the frames of the two formats. Furthermore, the order of information of image frames may be adjusted so as to set an image frame of allowable largest format among the three or more formats in consideration of a size of the remaining region.

It is noted that, for the recording sheet strips 20*a*, 20*b*, 80*a*, 80*b*, 90*a* and 90*b*, a preferred example of inkjet recording paper is disclosed in JP-A 8-310110. A support in the recording paper is coated with two or more ink receiving layers, each of which includes at least synthetic non-crystalline silica and aqueous binder. An average diameter of particles of the synthetic non-crystalline silica included in the uppermost one of the ink receiving layers is 6–15 μm. An average diameter of particles of the synthetic non-crystalline silica included in the remaining ink receiving layers is 1–5 μm. It is preferable in manufacturing the recording paper that a curtain coater is used to form the ink receiving layers, at least to form the uppermost ink receiving layer.

Also, another example of ink jet recording paper is disclosed in JP-A 8-310113. A support in the recording paper is coated with an ink receiving layer, which includes synthetic non-crystalline silica, aqueous binder, and also sulfosuccinic acid dialkyl ester. Preferable examples of sulfosuccinic acid dialkyl esters are sulfosuccinic di-4-methyl pentyl ester and/or sulfosuccinic di-2-ethyl hexyl ester. The use of the sulfosuccinic di-4-methyl pentyl ester is very effective in preventing unevenness in image quality. Thus, the sulfosuccinic di-2-ethyl hexyl ester may be additionally used in the ink receiving layer having the sulfosuccinic di-4-methyl pentyl ester as principal component of the ink receiving layer.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An ink jet printer for forming an image frame in a continuous recording sheet at a size PL with reference to a feeding direction of said continuous recording sheet, said ink jet printer comprising:

said continuous recording sheet including plural recording sheets, and a splicing portion for splicing said plural recording sheets to one another in one line;

a feeder mechanism for feeding said continuous recording sheet in said feeding direction;

a printing head for printing said image frame to said continuous recording sheet being fed;

a splice sensor, disposed upstream from said printing head at a distance L1, for detecting said splicing portion, where PL≦L1; and a controller for inhibiting said printing head from printing said image frame if an unavailable region including said splicing portion is estimated to overlap on a region of said image frame according to a detection signal from said splice sensor.

2. An ink jet printer as defined in claim 1, wherein L1≦2PL.

3. An ink jet printer as defined in claim 1, wherein said controller causes said continuous recording sheet to move until said unavailable region comes past said printing head, and then allows printing of said image frame.

4. An ink jet printer as defined in claim 3, further comprising a cutter for cutting away said unavailable region.

5. An ink jet printer as defined in claim 4, wherein said cutter is disposed upstream from said printing head in said feeding direction.

6. An ink jet printer as defined in claim 4, wherein said cutter is disposed downstream from said printing head in said feeding direction;

further comprising a shifter mechanism for shifting one of said printing head and said continuous recording sheet from remainder thereof while said splicing portion moves past said printing head, to prevent said printing head from interfering with said splicing portion.

7. An ink jet printer as defined in claim 6, wherein said shifter mechanism includes at least two shifter rollers, disposed upstream and downstream from said printing head, for being rotated and for shifting said continuous recording sheet away from said printing head.

8. An ink jet printer as defined in claim 7, wherein said continuous recording sheet includes splicing information, positioned with said splicing portion, for representing said splicing portion;

wherein said splice sensor detects said splicing portion by reading said splicing information.

9. An ink jet printer as defined in claim 8, wherein said splicing information comprises a splicing indicia.

10. An ink jet printer as defined in claim 8, wherein said splicing information is constituted by a through hole.

11. An ink jet printer as defined in claim 6, wherein said splice sensor is constituted by a thickness measurer for detecting a thickness of said continuous recording sheet;

said controller detects said splicing portion by comparing said thickness with a reference thickness.

12. An ink jet printer as defined in claim 6, wherein said splicing portion includes adhesive agent for attaching said plural recording sheets to one another.

13. An ink jet printer as defined in claim 6, wherein said splicing portion includes an adhesive tape for attaching said plural recording sheets to one another.

14. An ink jet printer as defined in claim 6, wherein said plural recording sheets include:

a support material; and a resin layer, formed on at least one surface of said support material, overlapped with one other recording sheet, and adapted to ultrasonic welding for splicing.

15. An ink jet printer defined in claim 1, further comprising a rotary encoder which monitors a rotational amount of a motor of said feeder mechanism and sends a signal to said controller for measuring a feeding amount of said continuous recording sheet by means of feeder roller sets of said feeder mechanism.

16. An ink jet printer defined in claim 1, further comprising a separation guide plate pivotally movable about an axis of a roller of said feeder mechanism, said separation guide plate moving between a first and second position, wherein a cut portion of said continuous recording sheet will be ejected away from said feeder mechanism when said separation guide plate is in one of said first and second positions.

17. An ink jet printer for forming an image frame in a continuous recording sheet at one of sizes PL and HL with reference to a feeding direction of said continuous recording sheet, where PL>HL, said ink jet printer comprising:

said continuous recording sheet including plural recording sheets, and a splicing portion for splicing said plural recording sheets to one another in one line;

a feeder mechanism for feeding said continuous recording sheet in said feeding direction;

a printing head for printing said image frame to said continuous recording sheet being fed;

a splice sensor, disposed in a predetermined position upstream from said printing head in said feeding direction, for detecting said splicing portion while said continuous recording sheet is fed; and a controller for allowing said printing head to print said image frame irrespective of said sizes PL and HL if an unavailable region including said splicing portion is estimated to come outside or come adjacent to an image frame region having said size PL according to a detection signal from said splice sensor, said controller allowing said printing head to print said image frame having said size HL in inhibiting said printing head from printing said image frame having said size PL if said unavailable region is estimated to overlap on said image frame region having said size PL according to said detection signal, said controller inhibiting said printing head from printing said image frame having said size HL if said unavailable region is estimated to overlap on an image frame region having said size HL according to said detection signal.

18. An ink jet printer as defined in claim 17, wherein said controller, if said unavailable region is estimated to overlap on said image frame region having said size PL, and estimated to come outside or come adjacent to said image frame region having said size HL, and if said image frame ready to be printed has said size PL, provides printing priority of an image frame having said size HL over said image frame having said size PL.

19. An ink jet printer defined in claim 17, further comprising a rotary encoder which monitors a rotational amount of a motor of said feeder mechanism and sends a signal to said controller for measuring a feeding amount of said continuous recording sheet by means of feeder roller sets of said feeder mechanism.

20. An ink jet printing method of forming an image frame in a continuous recording sheet at a size PL with reference to a feeding direction of said continuous recording sheet, said ink jet printing method comprising steps of:

said continuous recording sheet including plural recording sheets, and a splicing portion for splicing said plural recording sheets to one another in one line;

printing said image frame to said continuous recording sheet with a printing head while said continuous recording sheet is fed in said feeding direction;

detecting whether said splicing portion comes past a predetermined position upstream from said printing head at a distance L1, where L1>PL; and inhibiting said printing head from printing said image frame if an unavailable region including said splicing portion is estimated to overlap on a region of said image frame according to a detection signal from said detecting step.

21. An ink jet printing method of forming an image frame in a continuous recording sheet at one of sizes PL and HL with reference to a feeding direction of said continuous recording sheet, where PL>HL, said ink jet printing method comprising steps of:

said continuous recording sheet including plural recording sheets, and a splicing portion for splicing said plural recording sheets to one another in one line;

printing said image frame to said continuous recording sheet with a printing head while said continuous recording sheet is fed in said feeding direction;

while said continuous recording sheet is fed, detecting said splicing portion in a predetermined position upstream from said printing head in said feeding direction; and allowing said printing head to print said image frame irrespective of said sizes PL and HL if an unavailable region including said splicing portion is estimated to come outside or come adjacent to an image frame region having said size PL according to a detection signal from said detecting step, wherein said printing head is allowed to print said image frame having said size HL in inhibiting said printing head from printing said image frame having said size PL if said unavailable region is estimated to overlap on said image frame region having said size PL according to said detection signal, and wherein said printing head is inhibited from printing said image frame having said size HL if said unavailable region is estimated to overlap on an image frame region having said size HL according to said detection signal.

22. An ink jet printing method as defined in claim 21, further comprising a step of, if said unavailable region is estimated to overlap on said image frame region having said size PL, and estimated to come outside or come adjacent to said image frame region having said size HL, and if said image frame ready to be printed has said size PL, providing printing priority of an image frame having said size HL over said image frame having said size PL.

* * * * *

UNITED STATES PATENT AND TRADEMARK OFFICE

CERTIFICATE OF CORRECTION

PATENT NO. : 6,575,546 B2
DATED : June 10, 2003
INVENTOR(S) : Nobuo Matsumoto et al.

It is certified that error appears in the above-identified patent and that said Letters Patent is hereby corrected as shown below:

Title page,
Item [57], ABSTRACT,
Line 7, change “printing bead while” to -- printing head while --.

Column 13,
Line 38, change “>” to -- ≥ --.

Signed and Sealed this

Twenty-third Day of September, 2003

JAMES E. ROGAN
*Director of the United States Patent and Trademark Office*